US005720844A

United States Patent [19]

Hanson

[11] Patent Number: 5,720,844

[45] Date of Patent: Feb. 24, 1998

[54] FLOOR COVERING REMOVAL APPARATUS AND METHOD

[76] Inventor: Keith Hanson, 5802 Wallace St., Wichita, Kans. 67218

[21] Appl. No.: 638,848

[22] Filed: Apr. 29, 1996

[51] Int. Cl.[6] ..... B32B 31/18

[52] U.S. Cl. ..... 156/344; 156/584; 299/37.1

[58] Field of Search ..... 156/344, 584; 30/170; 299/37.1

[56] References Cited

U.S. PATENT DOCUMENTS

| | | | |
|---|---|---|---|
| 3,350,256 | 10/1967 | Eckman et al. | 156/497 |
| 4,277,104 | 7/1981 | Sanchez | 299/37 |
| 4,394,052 | 7/1983 | Adams et al. | 299/18 |
| 4,533,118 | 8/1985 | Thomas et al. | 254/202 |
| 4,560,146 | 12/1985 | Thomas et al. | 254/202 |
| 4,626,033 | 12/1986 | Anderson | 299/37 |
| 4,669,784 | 6/1987 | Grasse | 299/37 |
| 4,790,125 | 12/1988 | Merritt, III | 53/587 |
| 4,948,451 | 8/1990 | Folz | 156/344 |
| 4,963,224 | 10/1990 | Anderson | 156/584 |
| 5,002,629 | 3/1991 | Nakamura | 156/584 |
| 5,348,608 | 9/1994 | Glenn et al. | 156/344 |
| 5,387,308 | 2/1995 | Heavrin | 156/584 |
| 5,415,725 | 5/1995 | Scharf | 156/584 |
| 5,454,899 | 10/1995 | Glenn et al. | 156/584 |
| 5,456,794 | 10/1995 | Barrett | 156/584 |

FOREIGN PATENT DOCUMENTS

WO92/03290 3/1992 WIPO .

*Primary Examiner*—Mark A. Osele
*Attorney, Agent, or Firm*—Fields & Johnson, P.C.

[57] ABSTRACT

A floor covering removal apparatus and method are provided. The apparatus includes a frame for supporting the apparatus and a pair of interlocking gears which selectively and controllably feed a desired width of floor covering through the apparatus. One of the gears is driven by a drive which causes the apparatus to displace over a floor surface as the floor covering is fed through the apparatus. Cutting blades are mounted to the frame which cut the floor covering prior to engaging with the interlocking gears. A locking handle is provided to positively lock the floor covering between the interlocking gears prior to displacement of the apparatus along the floor surface. A control assembly enables an operator to selectively control the direction in which the apparatus is displaced.

35 Claims, 6 Drawing Sheets

FLOOR COVERING REMOVAL APPARATUS AND METHOD

TECHNICAL FIELD

This invention relates to an apparatus and method of removing elongated strips of material which are secured to a base surface, and more particularly, to an apparatus and method for removing floor coverings from a floor surface.

BACKGROUND ART

A number of prior art apparatuses and methods exist for removing floor coverings from a floor surface, such as manual or automatic carpet stripping machines. Recently, in an attempt to avoid the strenuous physical exertion to manually remove floor coverings from a floor surface, automatic machines have been developed to more efficiently remove such floor coverings.

One example of a prior art device and method is found in U.S. Pat. No. 4,948,451 to Foltz. This invention relates to a self-propelled carpet stripping apparatus including a frame and a pair of driven rollers for rotation about a horizontally disposed parallel axis. The rollers are operable for receiving a loose end of a carpet therebetween to pull the carpet up off its supporting surface. As the carpet is pulled by the action of the rollers, the apparatus is propelled forward and the carpet is simultaneously cut by a pair of knives which are mounted adjacent the driven rollers.

U.S. Pat. No. 5,415,725 to Scharf discloses a device for removing carpet from a floor surface. The apparatus includes a frame and a pair of drive rollers journaled in respective side walls of the frame. A pressure roller extends between the side walls and is spaced a predetermined vertical distance below the pair of drive rollers. The pressure roller is journaled between a pair of leverage arms that are pivotally mounted on the side walls. The drive rollers are driven by a motor which is mounted on the frame. In operation, a portion of removed carpet is threaded over the pressure roller and under the drive rollers. Downward pressure on a handle causes the leverage arms to pivot the pressure roller upwardly toward the drive rollers. Once the carpet is wedged between the pressure roller and drive rollers, the motor is energized causing the drive motor to engage the drive rollers for pulling the carpet up from the floor as the apparatus travels along the floor surface. A knife mechanism mounted to the frame cuts the carpet as it is drawn into the apparatus.

U.S. Pat. Nos. 5,002,629 and 4,963,224 each teach a motorized floor covering removing apparatus which incorporate a peeling blade to remove a floor covering from a floor surface.

While each of the foregoing references may be adequate for their intended purposes, they each contain certain disadvantages which are overcome by the invention claimed and disclosed herein. For example, the apparatus and method of this invention provide a more positive means for engaging a floor surface and ensuring that the floor covering is continuously and controllably fed through the apparatus in order to more effectively remove the floor covering. Furthermore, the apparatus and method of this invention include a novel locking mechanism which enables the floor covering to more easily be fed into the apparatus and also provides additional control when feeding floor covering into the apparatus.

DISCLOSURE OF THE INVENTION

In accordance with the present invention, a floor covering removal apparatus and method are provided. In its simplest form, the apparatus of this invention includes a frame assembly for supporting the apparatus, the frame assembly including a plurality of supports. A pair of front and rear wheels are mounted to the frame assembly enabling the apparatus to be displaced along a floor covering. A locking assembly is mounted to the frame assembly for providing a means for positively locking the floor covering as it is fed through the apparatus. The locking assembly includes a locking handle rotatably connected to the frame assembly and to a compression rod assembly. The compression rod assembly is coupled to a compression gear which meshes with a drive gear in order to engage the floor covering. The compression rod assembly induces a continuous and selectively variable force upon the compression gear so as to adequately secure the floor covering between the compression and drive gears. A drive assembly mounted to the frame assembly powers the rotation of the drive gear. A pair of cutter assemblies mounted on the frame assembly cut the floor covering into elongated strips as the floor covering is fed between the compression and drive gears. Skid plates positioned adjacent the cutter assemblies ensure that the floor covering does not become entangled or bunched up prior to being fed into the apparatus.

The method of the invention claimed herein provides an improved manner in which to remove floor coverings from a floor surface. According to this method, a precut free end of floor covering is inserted between the drive gear and compression gear. The locking assembly is then manipulated to lock the compression gear against the drive gear. The drive motor is energized which causes the drive gear to engage the compression gear which, in turn, causes the floor covering to be pulled away from the floor surface and fed between the drive gear and compression gear. Simultaneously, as the apparatus begins to be displaced along the floor surface, the cutter assembly cuts the floor covering into elongated strips of a specified width. A safety interlock is provided to deenergize the drive motor upon the desire of an operator.

The use of a pair of gears for controllably feeding a floor covering through the apparatus provides a positive means to ensure the floor covering does not slip or otherwise feed through the apparatus at an odd angle. Furthermore, the use of the locking assembly enables an operator to more easily position the free end of the floor covering between the drive gear and compression gear, and further provides structure for securely locking the floor covering in a desired position with respect to the gears prior to energizing the drive motor. The variable force exerted by the compression rod assembly provides a means for the apparatus to automatically handle floor coverings of differing thicknesses.

In use, the invention claimed herein has proven effective for not only removing floor coverings like carpet, but also other coverings such as linoleum.

Each of the foregoing advantages of this invention are achieved with a relatively simple structure which may be manufactured at a minimum cost.

Additional advantages of this invention will become apparent from the description which follows, taken in conjunction with the accompanying drawings.

BEST MODE FOR CARRYING OUT THE INVENTION

Figure 1:
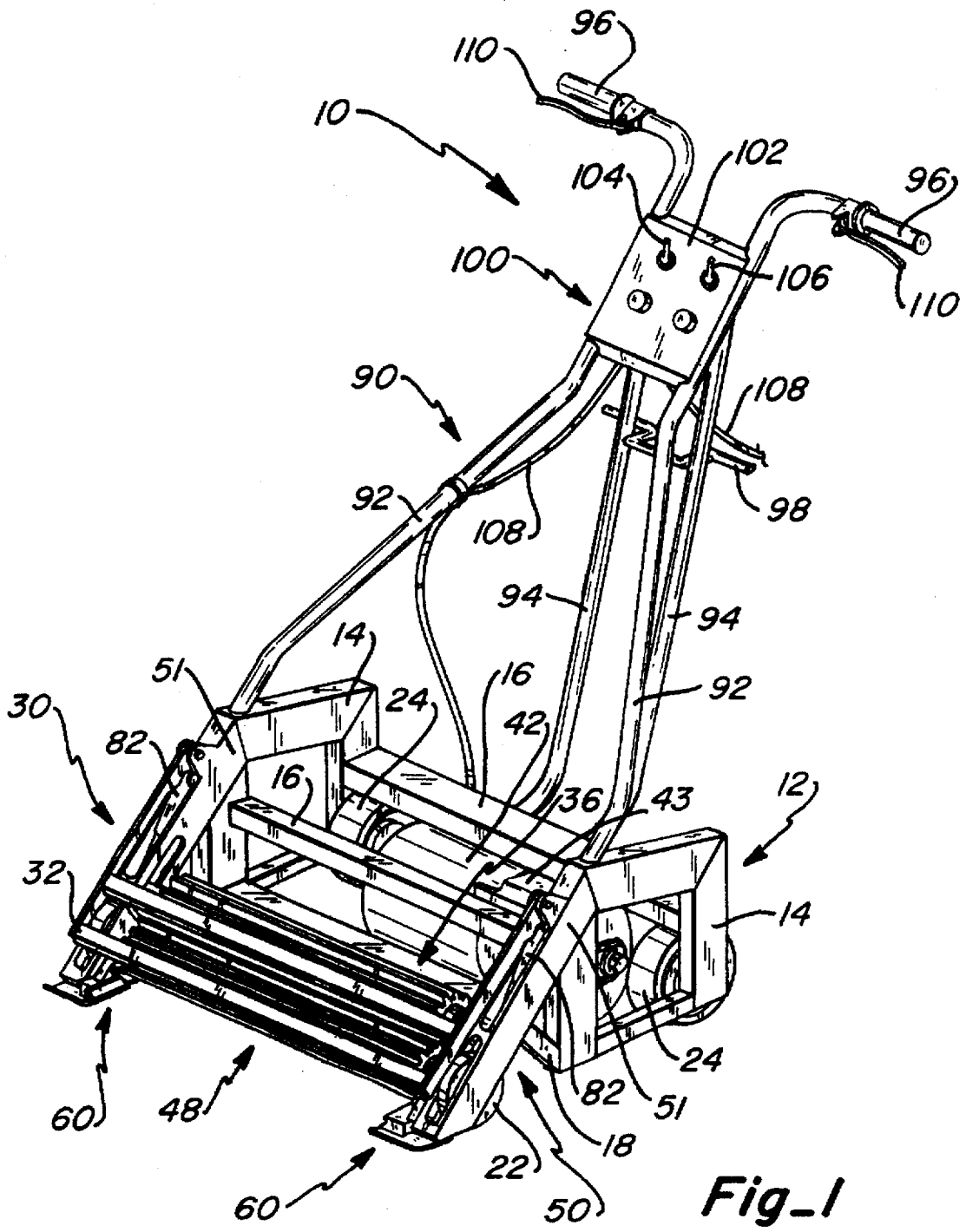
FIG. 1 is a perspective view of the floor covering removal apparatus of this invention.

As shown in FIG. 1, a floor covering removal apparatus 10 is shown which includes a frame assembly 12 comprising a pair of end support assemblies 14, and a plurality of longitudinal supports 16 interconnecting the end support assemblies 14. A pair of front wheels 22 are journaled on the lower ends of corresponding leg assemblies 50. Rear wheels 24 are journaled on the interior sides of each end support assembly 14.

As best seen in FIGS. 5–8, locking assembly 30 includes a locking handle 32 which is rotatably mounted by means of locking handle pin 59 to locking handle eye bracket 58 of leg assembly 50. Additionally, the proximal end 33 of locking handle 32 receives compression rod pin 39 for attachment of the proximal end 33 of locking assembly 30 to compression rod assembly 80.

Figure 6:
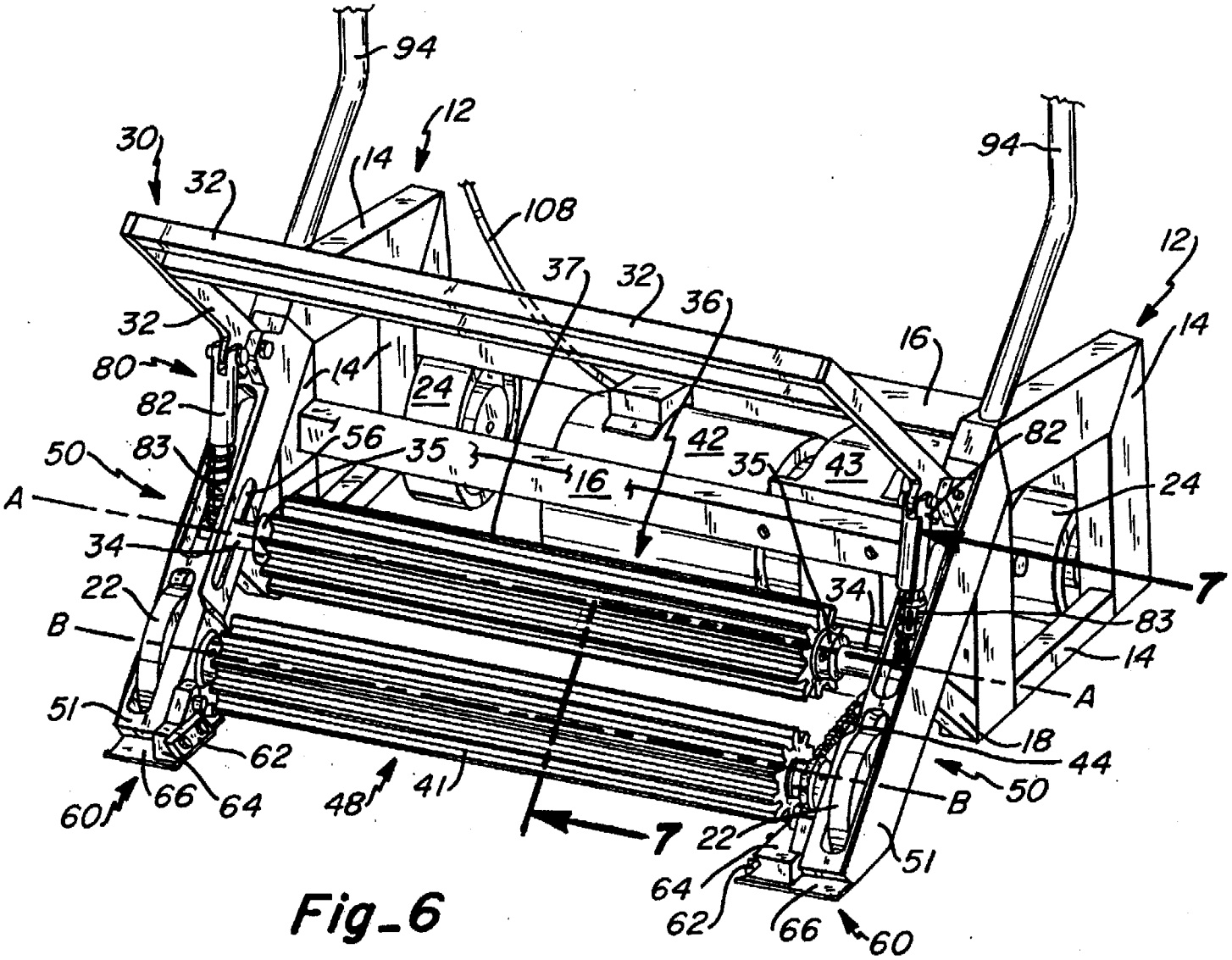
FIG. 6 is a enlarged, partial fragmentary, front perspective view of the floor covering removal apparatus of this invention illustrating the locking assembly in the unlocked position.
Figure 8:
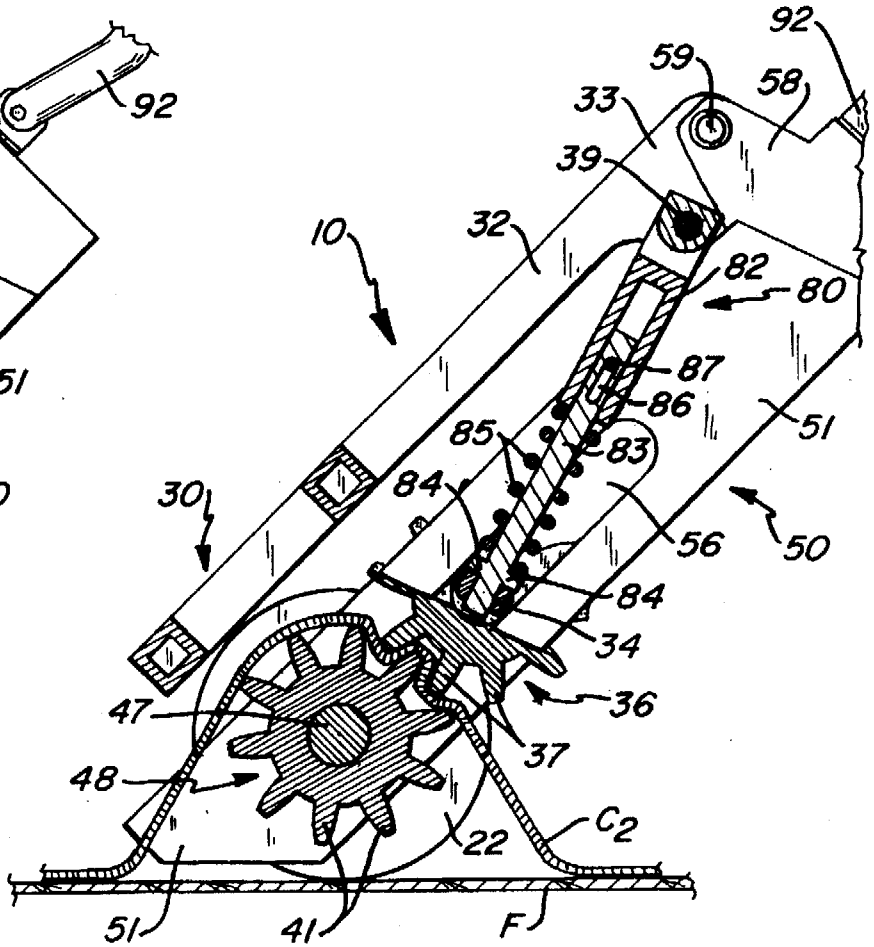
FIG. 8 is another partial, fragmentary vertical section, taken along line 7—7 of FIG. 6, illustrating the guide rod pin within the guide rod slot of the compression rod assembly when the floor covering removal apparatus of this invention engages a relatively thin floor covering.
Figure 7:
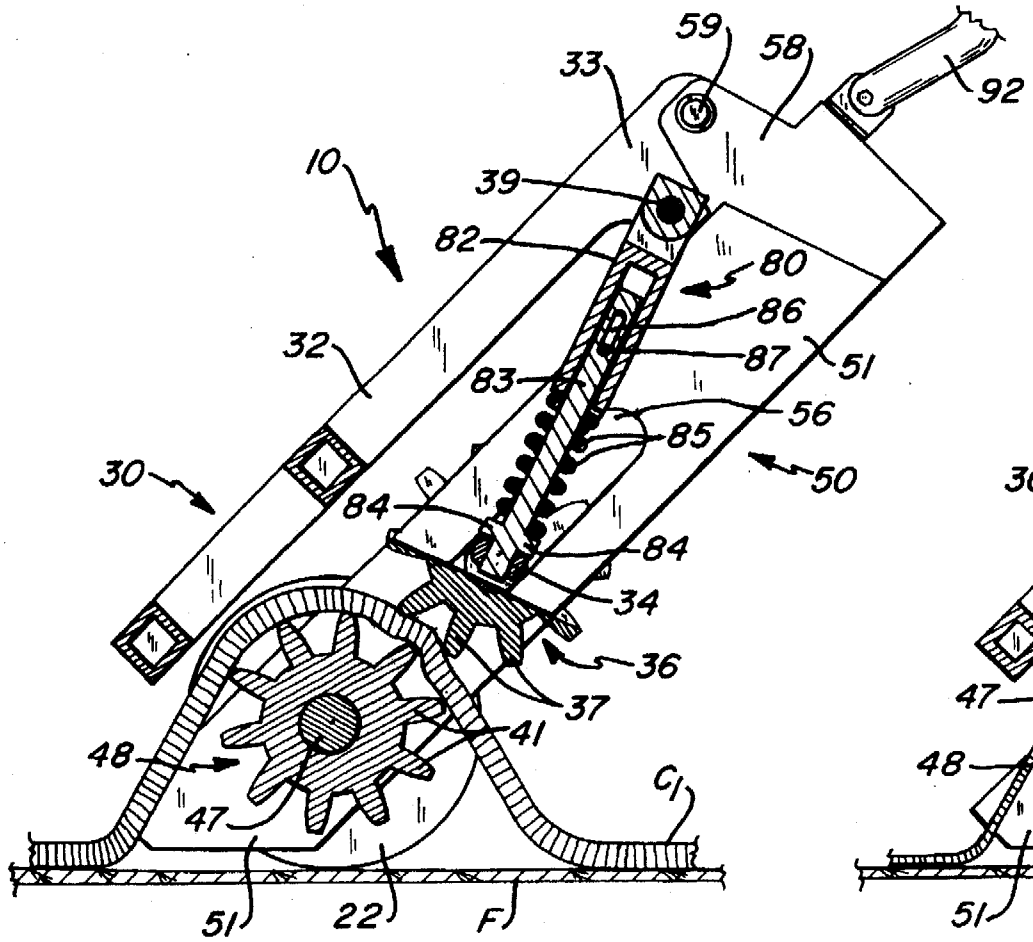
FIG. 7 is a partial, fragmentary vertical section, taken along line 7—7 of FIG. 6, illustrating the positioning of the guide rod pin within the guide rod slot of the compression rod assembly when the floor covering removal apparatus of this invention has engaged between the compression gear and drive gear a relatively thick floor covering.

As best seen in FIG. 6–8, each compression rod assembly 80 is attached to opposite ends of compression shaft 34. Shaft 34 extends along axis A—A and is inserted between side slots 56 of each of the leg assemblies 50. Compression gear 36 is concentrically mounted over compression shaft 34 and freely rotates around shaft 34 by means of integral shaft bearings 35 which are slipped over opposite ends of shaft 34. Compression gear 36 may freely reciprocate within slots 56, as will be discussed below, depending upon the thickness of the floor covering inserted between compression gear 36 and drive gear 48.

Figure 4:
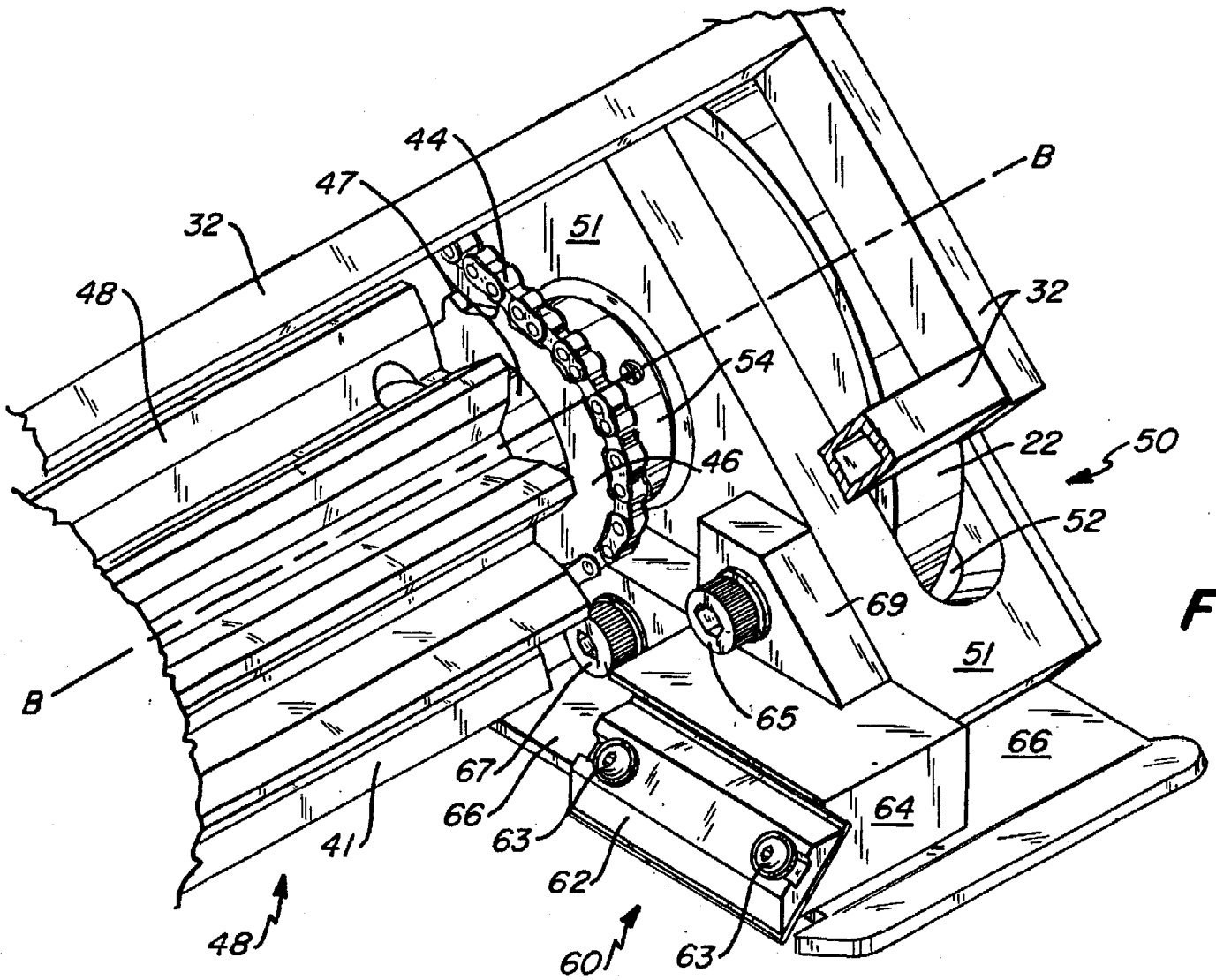
FIG. 4 is an enlarged, fragmentary perspective view of the cutter assembly of the floor covering removal apparatus of this invention.
Figure 5:
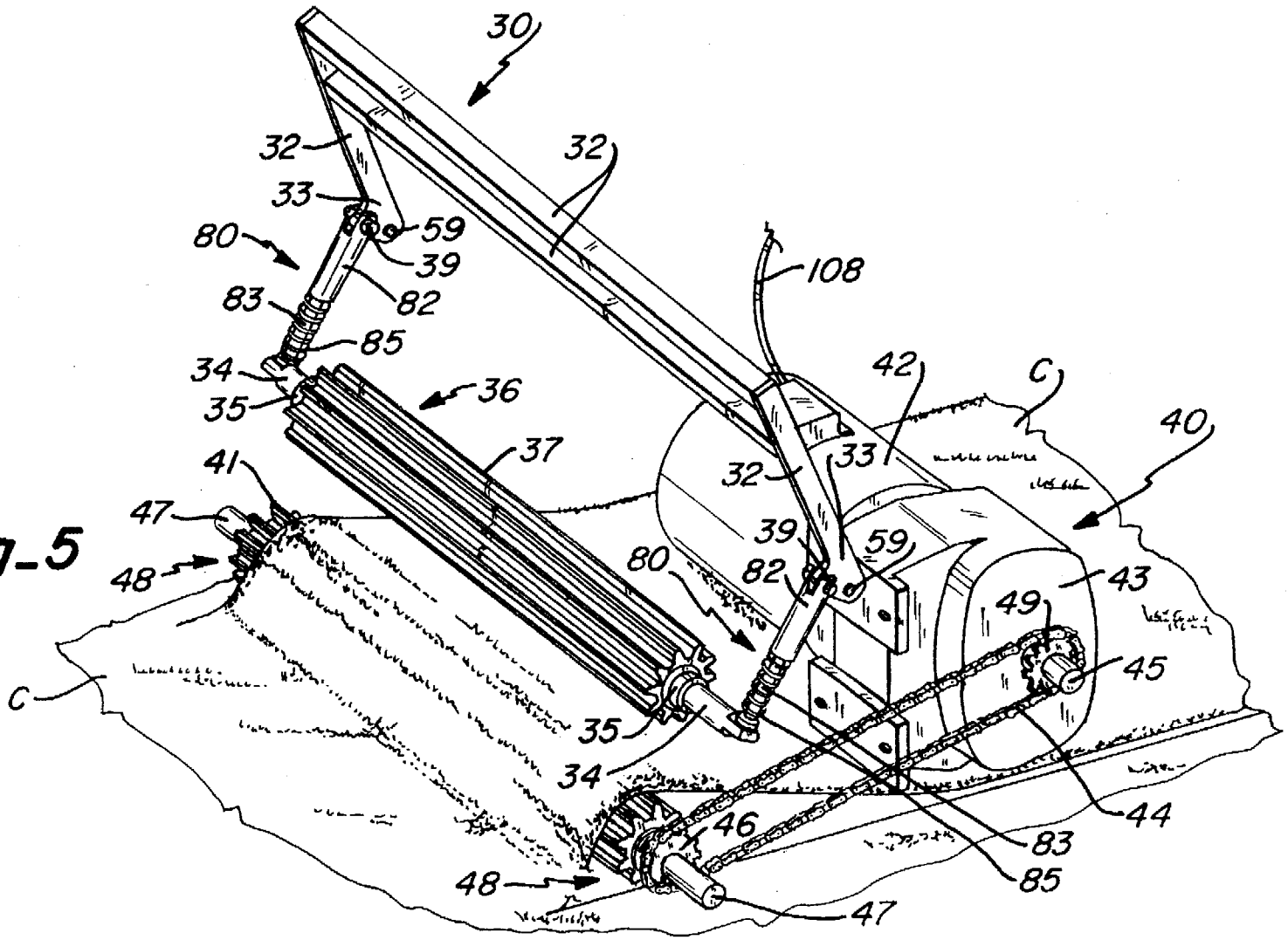
FIG. 5 is a partial fragmentary, rear perspective view of the locking assembly and drive assembly of the floor covering removal apparatus of this invention illustrating the positioning of a floor covering while the locking assembly is in an unlocked position.

As best seen in FIGS. 5 and 6, drive assembly 40 includes motor 42 which communicates with gear reducer 43. Reducer 43 translates rotational movement to drive shaft 47 via output shaft 45 and drive sprocket 49. As shown, drive connector 44 connects driven sprocket 46 of drive shaft 47 to drive sprocket 49. Drive shaft 47 extends along axis B—B which is parallel to and spaced from axis A—A. Drive gear 48 is concentrically mounted over shaft 47. As best seen in FIGS. 4 and 6, drive shaft 47 is journaled on bearings 54 which are mounted on opposing legs 51 of each leg assembly 50. Front wheels 22 are inserted within lower front slot 52 and are aligned along axis B—B. However, wheels 22 are not drivingly linked to driven sprocket 46, and are therefore free to rotate within slots 52 by being slipped over opposing ends of drive shaft 47.

As best seen in FIG. 4, the apparatus 10 further includes a pair of cutter assemblies 60 each including a support block 64. Each support block 64 includes a flange 69 which mounts the block 64 to corresponding leg 51 by means of fastener 65. A cutting blade 62 is secured to each support block 64 by corresponding cutting blade fasteners 63. Mounted below each support block 64 and exteriorly of cutting blade 62 is skid plate 66. Skid plate 66 enables the apparatus to smoothly glide over a floor covering and helps prevent the floor covering from becoming entangled as it passes between gears 36 and 48. Skid plate 66 attaches to a corresponding leg 51 by means of skid plate fastener 67.

As best seen in FIGS. 7 and 8, the apparatus 10 B includes a pair of compression rod assemblies 80 which are positionable within upper front slots 53 formed in each of the legs 51. Each compression rod assembly 80 includes push sleeve 82 which is mounted over guide rod 83. Each guide rod 83 includes at its lower end a guide rod flange 84. Positioned between the lower ends of push sleeves 82 and guide rod flanges 84 is a corresponding spring 85. The upper ends of guide rods 83 each include a guide rod slot 86 and guide rod pin 87 which are fixedly attached to its matching push sleeve 82.

As seen in FIG. 7, when it is desired to remove floor covering C1 from the floor surface F, covering C1 is routed between gears 36 and 48. According to the thickness of the floor covering C1, compression shaft 34 is free to reciprocate within the limits of side slots 56 to accommodate varying thicknesses of differing floor coverings. However, the extent of the movement of each shaft 34 within slot 56 is delimited by the length of guide rod slot 86 since guide rod pin 87 is fixedly attached to push sleeve 82. Spring 85 ensures that adequate pressure is placed against compression gear 36 in order that floor covering C1 is smoothly and continuously fed between gear 36 and gear 48. FIG. 7 illustrates the apparatus 10 engaging a relatively thick floor covering C1 wherein the guide rod pin 87 is positioned against the lower end of guide rod slot 86. FIG. 8 illustrates the apparatus 10 engaging a relatively thin floor covering C2 wherein the guide rod pin 87 is positioned against the upper end of guide rod slot 86. Thus, the guide rod assemblies 80 are able to automatically adjust, enabling the apparatus of this invention to remove floor coverings of differing thickness without manual intervention by an operator. Although a particular length of slot 86 is shown in FIGS. 7 and 8, it will be understood by those skilled in the art that the length of slot 86 can be modified to accommodate a wide range of floor coverings having varying thicknesses. Furthermore, the size and biasing strength of spring 85 may be modified to enable compression gear 36 to place the proper amount of pressure upon a floor covering as it passes between gear 36 and gear 48.

As shown in FIGS. 7 and 8, the rotation of drive gear 48 enables gear teeth 41 of drive gear 48 to interlock with gear teeth 37 of compression gear 36. The interlocking or meshing of teeth 37 and 41 ensures that the floor covering does not slip as it passes between gear 36 and gear 48.

Figure 3:
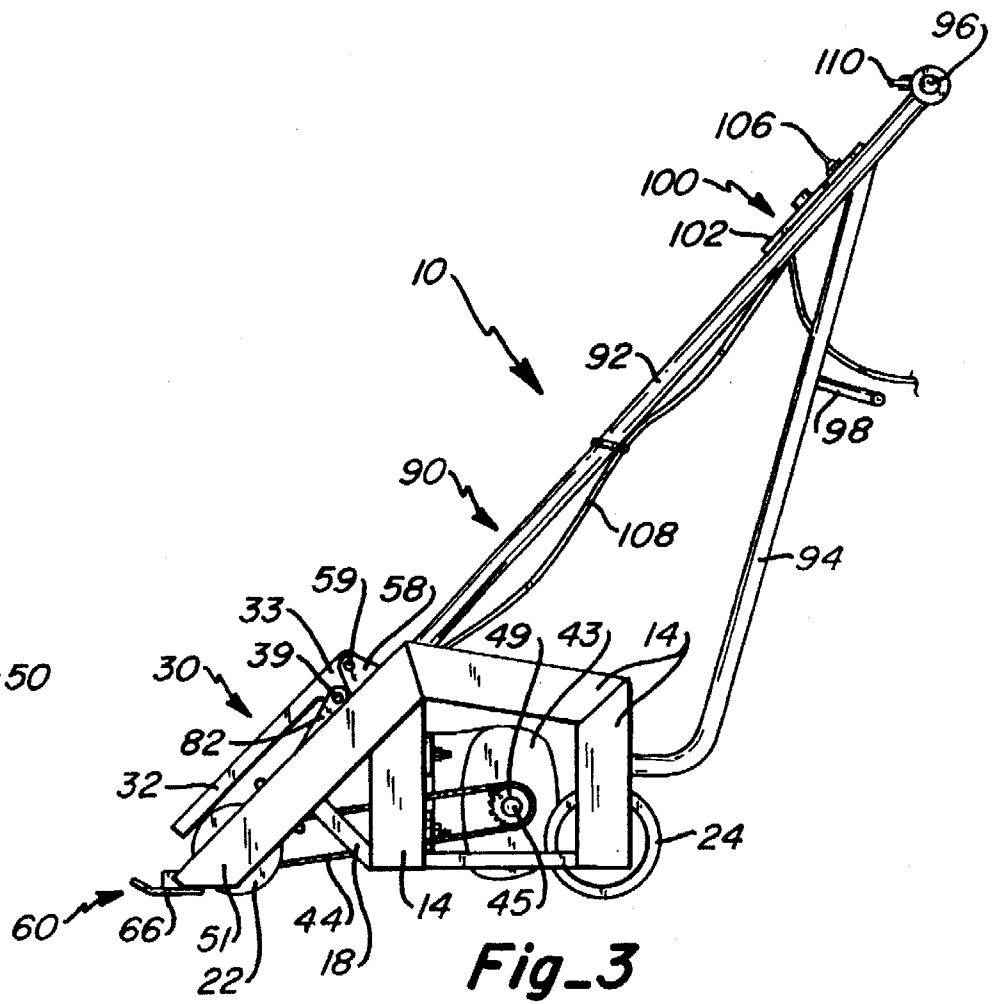
FIG. 3 is a left side elevation of the floor covering removal apparatus of this invention.
Figure 2:
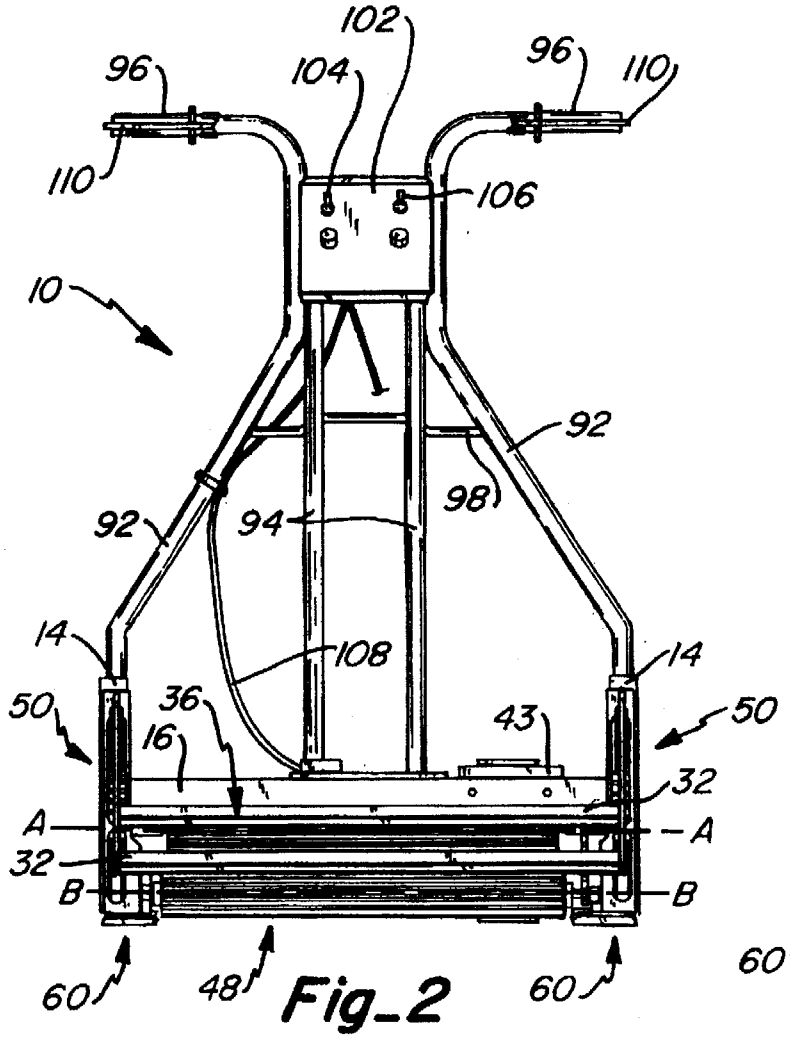
FIG. 2 is a front elevation view of the floor covering removal apparatus of this invention.

Referring back to FIGS. 1–3, control support assembly 90 attaches to frame assembly 12 and includes a pair of forward support bars 92 and rear support bars 94. Handles 96 are formed as the free ends of the support bars 92. Conveniently, cord spool 98 attaches to support bars 94 in order that power cord 108 may be stored when not in use. As shown, cord 108 provides electric power to motor 42 through control assembly 100. Control assembly 100 includes control panel 102 which is mounted on support bars 92. Power switch 104 and mode switch 106 are mounted to control panel 102 for selective control of the operation of the apparatus. Power switch 104 energizes/denergizes motor 42. Mode switch 106 controls the rotation of output shaft 45 in either a clockwise or counter clockwise rotation which corresponds to the forward or reverse movement of the apparatus along a floor covering. Safety interlock switches 110 are electrically coupled to motor 42 to enable an operator to instantaneously stop the movement of the apparatus when desired.

According to the operation of the floor covering apparatus of this invention, to remove a desired width of floor covering from a floor, a loose end of the floor covering is inserted between gears 36 and 48 while the locking handle 32 is in the unlocked position. The locking handle 32 is then placed in the locked position by exerting force downward on the handle. When in the locked position, compression gear 36 exerts pressure upon the floor covering according to the biasing force of the spring 85. Gear 36 is free to displace within slot 56 according to the length of guide rod slot 86. An operator may then flip power switch 104 to the on position and grasp interlock switches 110 which enables the drive motor 42 to power the drive gear 48. As the apparatus pulls the floor covering through gears 36 and 48, cutter assemblies 60 cut the floor covering into the desired width.

This invention has been described in detail with reference to a particular embodiment thereof, but it will be understood that various other modifications can be effected within the spirit and scope of this invention.

I claim:

1. A floor covering removal apparatus for removing a floor covering from a floor surface comprising:

a frame for supporting said apparatus;

a locking handle rotatably mounted to said frame;

a drive gear rotatably mounted to said frame for selectively pulling floor covering through said apparatus to displace said apparatus along the floor surface, said drive gear including a first plurality of teeth;

a compression gear mounted adjacent said drive gear, said compression gear including a second plurality of teeth which interlock with said first plurality of teeth;

at least one compression rod rotatably mounted between said handle and said compression gear;

at least one cutter mounted to said frame for cutting the floor covering as the apparatus is displaced along the floor surface; and wherein the interlocking engagement of said compression gear with said drive gear causes the floor covering to be controllably fed therebetween for pulling and removing the floor covering from the floor.

2. An apparatus, as claimed in claim 1, further including:

a plurality of wheels mounted to said frame.

3. An apparatus, as claimed in claim 1, further including:

a reversible motor mounted to said frame; and a drive connector interconnecting said reversible motor to said drive gear enabling said motor to rotate said drive gear in either a forward or reverse direction.

4. An apparatus, as claimed in claim 1, wherein said at least one cutter includes:

a cutting blade portion positionable in contact with the floor covering; and a skid plate mounted adjacent to said cutter blade portion on said frame preventing the floor covering from bunching up prior to feeding it between said drive gear and said compression gear.

5. An apparatus, as claimed in claim 1, wherein said compression rod includes:

an integral spring to provide continuous and selectively variable pressure on said compression gear throughout a desired range of motion enabling said apparatus to engage floor coverings of differing thicknesses.

6. An apparatus, as claimed in claim 1, further including:

a control electrically coupled to said reversible motor for selectively controlling the pulling of the floor covering from the floor and the displacement of said apparatus along the floor surface.

7. An apparatus, as claimed in claim 6, wherein said control includes:

at least one safety interlock electrically coupled to said reversible motor for selectively de-energizing said reversible motor.

8. A floor covering removal apparatus for removing a floor covering from a floor surface comprising:

a frame for supporting said apparatus;

means mounted to said frame for controllably feeding the floor covering through said apparatus in order to remove the floor covering from the floor surface;

means cooperating with said feeding means for locking the floor covering in engagement with the feeding means; and a cutter means mounted to said frame for cutting the floor covering as the apparatus is displaced along the floor surface, said cutter means including a skid plate which slides over the floor covering to prevent it from bunching up prior to being fed between said feeding means.

9. An apparatus, as claimed in claim 8, further including:

means for compressing the floor covering in engagement with said feeding means as the floor covering is fed through said feeding means.

10. An apparatus, as claimed in claim 8, further including:

means coupled to said feeding means for controlling the feeding of the floor covering through the apparatus and the displacement of said apparatus along the floor surface.

11. A method of removing a strip of floor covering from a floor surface, the floor covering having a width and a free end that is separated from the floor surface, said method comprising the steps of:

positioning the free end of the strip in engagement with a floor covering removal apparatus;

engaging the free end of the strip of carpet with the apparatus;

locking the floor covering in engagement with the apparatus;

pulling the floor covering through the apparatus by means of a pair of interlocking gears having interlocking teeth to displace the apparatus along the floor surface;

cutting the floor covering to the width of the strip of floor covering as the apparatus is displaced in a forward direction; and expelling the free end of the floor covering away from the apparatus as the apparatus is displaced in the forward direction so that the floor covering is removed from the floor.

12. A method, as claimed in claim 11, further including the step of:

selectively de-energizing the apparatus as the apparatus is displaced along the floor.

13. A method, as claimed in claim 11, further including the step of:

displacing the apparatus in a reverse direction to free entanglements of the floor covering engaged with the apparatus.

14. A method, as claimed in claim 11, further including the step of:

automatically adjusting the spacing between the pair of interlocking gears to accommodate different thicknesses of floor coverings engaged by the apparatus.

15. A floor covering removal apparatus for removing a floor covering from a floor surface comprising:

a frame for supporting said apparatus;

a pair of interlocking gears mounted to said frame for controllably feeding the floor covering through said interlocking gears in order to remove the floor covering from the floor surface; and at least one cutting blade mounted to said frame and positioned adjacent said interlocking gears for cutting the floor covering as the apparatus is displaced along the floor surface.

16. An apparatus, as claimed claim 15, further comprising:

at least one compression rod rotatably mounted to said apparatus for applying a continuous and selectively variable pressure against said interlocking gears enabling said apparatus to engage floor coverings of differing thicknesses.

17. An apparatus, as claimed in claim 16, wherein said compression rod includes:

an integral spring mounted to said compression rod.

18. An apparatus, as claimed in claim 15, further including:

a locking handle rotatably mounted to said frame for selectively placing said interlocking gears in a position to controllably feed the floor covering therethrough.

19. An apparatus, as claimed in claim 15, further including:

a plurality of wheels mounted to said frame enabling said apparatus to roll along the floor covering.

20. An apparatus, as claimed in claim 15, further including:

a reversible motor mounted to said frame; and a drive connector interconnecting said reversible motor to said interlocking gears causing said reversible motor to rotate said interlocking gears in a desired direction of rotation.

21. An apparatus, as claimed in claim 15, further including:

a skid plate mounted adjacent said cutting blade to prevent the floor covering from bunching up prior to being fed between said interlocking gears.

22. A floor covering removal apparatus for removing a floor covering from a floor surface comprising:

a frame for supporting said apparatus;

a drive member rotatably mounted to said frame;

a compression member mounted adjacent said drive member for selectively engaging said drive member, said drive member and said compression member causing the floor covering to feed through said apparatus and to displace said apparatus along the floor surface;;

a cutting blade mounted to said apparatus for cutting the floor covering as the apparatus is displaced along the floor surface; and a skid plate mounted adjacent said cutting blade on said frame to prevent the floor covering from bunching up prior to being fed through said apparatus.

23. An apparatus, as claimed in claim 22, further including:

at least one compression rod rotatably mounted to said apparatus to provide continuous and selectively variable pressure on said compression member throughout a desired range of motion enabling said apparatus to engage floor coverings of differing thicknesses.

24. An apparatus, as claimed in claim 23, further including:

an integral spring mounted to said compression rod.

25. An apparatus, as claimed in claim 22, further including:

a locking handle rotatably mounted to said flame for selectively locking said compression member against said drive member.

26. An apparatus, as claimed in claim 22, further including:

a first plurality of spaced teeth protruding from an outer surface of said drive member; and a second plurality of spaced teeth protruding from an outer surface of said compression member, said first and second plurality of spaced teeth arranged so that when said drive member and said compression member rotate, said first and second plurality of spaced teeth interlock to cause the floor covering to be controllably feed therebetween.

27. A floor covering removal apparatus for removing a floor covering from a floor surface comprising:

a frame for supporting said apparatus;

a drive member rotatably mounted to said frame;

a compression member mounted adjacent to said drive member and selectively engaging said drive member to controllably pull the floor covering through said apparatus and to displace said apparatus along the floor surface;

at least one compression rod rotatably mounted to said frame, said compression rod including an integral spring to provide continuous and selectively variable pressure on said compression member throughout a desired range of motion enabling said apparatus to engage floor coverings of differing thicknesses.

28. An apparatus, as claimed in claim 27, further including:

a locking handle rotatably mounted to said frame for selectively placing said compression member in a locked position with respect to said drive member.

29. An apparatus, as claimed in claim 27, further including:

a cutting blade mounted to said apparatus for cutting the floor covering as the apparatus is displaced along the floor surface.

30. An apparatus, as claimed in claim 27, further including:

a skid plate mounted adjacent to said cutting blade to prevent the floor covering from bunching up prior to being fed between said drive member and said compression member.

31. An apparatus, as claimed in claim 27, further including:

a first plurality of spaced teeth protruding from an outer surface of said drive member; and a second plurality of spaced teeth protruding from an outer surface of said compression member, said first and second plurality of spaced teeth arranged so that when said drive member and said compression member rotate, said first and second plurality of spaced teeth interlock to cause the floor covering to be controllably feed therebetween.

32. A floor covering removal apparatus for removing a floor covering from a floor surface comprising:

a frame for supporting said apparatus;

means for interlocking gear engaging the floor covering to pull it through said apparatus and displace said apparatus along the floor covering;

a cutting blade mounted to said apparatus for cutting the floor covering as the apparatus is displaced along the floor surface; and a drive motor mounted to said frame and communicating with said interlockingly engaging means for the displacement of said apparatus along the floor surface.

33. An apparatus, as claimed in claim 32, further including:

at least one compression rod rotatably mounted to said frame to provide continuous and selectively variable pressure on said interlockingly engaging means throughout a desired range of motion enabling said apparatus to engage floor coverings of differing thicknesses.

34. An apparatus, as claimed in claim 32, further including:

a locking handle rotatably mounted to said frame enabling said interlockingly engaging means to be placed in a locked position.

35. An apparatus, as claimed in claim 32, further including:

a skid plate mounted adjacent said cutting blade to prevent the floor covering from bunching up prior to being fed between said interlockingly engaging means.

* * * * *